US007100661B1

(12) United States Patent
Pittman

(10) Patent No.: US 7,100,661 B1
(45) Date of Patent: Sep. 5, 2006

(54) AWNING TOPPER CURTAIN ROD EXTENDER

(75) Inventor: Jerry Pittman, Plainview, NY (US)

(73) Assignee: Ex-Cell Home Fashions, Inc., New York, NY (US)

( * ) Notice: Subject to any disclaimer, the term of this patent is extended or adjusted under 35 U.S.C. 154(b) by 0 days.

(21) Appl. No.: 11/075,349

(22) Filed: Mar. 8, 2005

(51) Int. Cl.
*E04F 10/00* (2006.01)

(52) U.S. Cl. ..... 160/38; 211/105.1; 248/262

(58) Field of Classification Search ..... 160/19, 160/38, 39; 211/105.2; 248/262
See application file for complete search history.

(56) References Cited

U.S. PATENT DOCUMENTS 1,201,799 A * 10/1916 Bond ..... 248/262
1,606,168 A * 11/1926 Lindberg ..... 248/262
1,743,608 A * 1/1930 Kenney ..... 248/263
4,341,252 A * 7/1982 Schenk ..... 160/45

* cited by examiner

*Primary Examiner*—Blair M. Johnson
(74) *Attorney, Agent, or Firm*—Epstein Drangel Bazerman & James, LLP; Robert L. Epstein

(57) ABSTRACT

The awning topper assembly is designed to be mounted on the interior side of a window. The assembly includes two curtain support rods of conventional design, each having a front and spaced, parallel sides. A valance is provided having upper and lower channels, each adapted to receive one of the support rods. Plastic extenders are provided for each side of the rod in the lower channel. Each extender engages a different side of the lower support rod, so as to retain the front of lower portion of the valance a greater distance from the plane of the window than the front of upper portion of the valance and thus provide an awning like appearance.

8 Claims, 3 Drawing Sheets

AWNING TOPPER CURTAIN ROD EXTENDER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to a window treatments in the form of curtain valances known as "toppers" and more particularly to extenders designed to convert a standard curtain rod for use with a topper in the form of an awning.

2. Description of Prior Art

Awnings designed for exterior use are well known in the art. They generally take the form of a flexible or rigid roof-like cover mounted at an incline and extending over or in front of a deck, door or window to provide shade from the sun and shelter from the elements.

Curtains designed for indoor use as a window drapery are also well known. One type of curtain that is commonly used is known as a valance or "topper" because it is designed to fit over the top of a window using a standard curtain support rod. The topper is usually made of fabric and hangs vertically from the support rod in a plane generally parallel to the inside of the window.

The standard curtain support rod used to mount toppers consists of two generally "L" shaped parts. The parts are fabricated such that the long portion of one part is slideably received into the long portion of the other part to form the main section of the rod. That structure permits the effective length of the rod to be easily adjusted. The short portions of the rod parts form generally parallel side sections. The side sections of the rod are hollow and have open ends designed to receive and engage mounting brackets fixed to the surface (wall or window frame) surrounding the window, so as to support the rod and hence the curtain.

The present invention relates to a decorative curtain topper designed for indoor use that has the appearance of an awning in that it is mounted at an incline relative to the window, instead of parallel to the window as is the case with standard toppers. In order to mount the awning topper at an incline relative to the window, two support rods are required. One rod is required to support the upper portion of the topper at a position relatively close to the window. A second rod is required to support the lower portion of the topper at a position spaced from the window. Supporting the lower portion at a position spaced further away from the window than the upper portion provides the inclined appearance of an awning.

The awning topper is provided with a channel proximate the top edge adapted to receive the upper support rod. A second channel is provided proximate the bottom of the topper and is adapted to receive the lower support rod.

A standard curtain rod functions acceptably as the upper support rod for the awning topper. However, a standard curtain rod cannot be used as the lower support rod for the awning topper because the sides are too short to provide the inclined appearance characteristic of an awning.

It is of course possible to manufacture a curtain rod with longer sides especially for use as the lower support rod for the awning topper. However, fabricating, inventorying and selling specially constructed curtain rods for this purpose is costly.

Accordingly, it is a prime object of the present invention to provide extenders for increasing the effective length of mounting to the sides of standard curtain rod to convert same for use as a lower support rod for an awning topper.

It is another object of the present invention to provide an awning topper rod extender that is inexpensive to manufacture and simple to use with a standard curtain rod.

It is another object of the present invention to provide an awning topper rod extender with a tapered end to facilitate insertion to the side section of a standard curtain rod.

It is another object of the present invention to provide an awning topper rod extender with means for releaseably engaging the side section of a standard curtain rod.

BRIEF SUMMARY OF THE INVENTION

In accordance with the present invention, an awning topper assembly is provided for mounting on the interior side of a window surrounded by a surface. The assembly includes first and second curtain support rods, each of having a front and a side. A valance is provided having upper and lower channels adapted to receive the first and second rods, respectively. Rod side extender means are adapted to engage the side of the second support rod, so as to retain the front of the second rod a greater distance from the surface surrounding the window than the front of the first rod.

The extender means also includes a surface adapted to abut the surface surrounding the window. The assembly abutting surface is generally circular in configuration.

The extender means has a body portion. Preferably, the abutting surface is larger than the body portion of the extender means.

The weight of the valance tends to push the abutting surface towards the surface surrounding the window.

The rod side has a recess. A portion of the extender means is adapted to be received within the recess in the rod side.

The rod side also has a protrusion-receiving recess. The extender means has a protrusion adapted to be received in the protrusion-receiving recess in the rod side.

The extender means preferably has a tapered tip.

The extender means preferably has first and second spaced, generally parallel legs.

The assembly extender means preferably has a gripping portion.

In accordance with another aspect of the present invention, an extender is provided for a curtain support rod of the type having a side. The extender includes an elongated body portion having first and second ends. The first end of the extender is adapted to engage the rod side. The second end of the extender has a surface spaced from the first end.

The first end of the extender is preferably tapered.

The extender body portion of the extender includes spaced, generally parallel legs.

The rod side has a recess. The first end of the extender has a protrusion adapted to be received in the rod side recess.

BRIEF DESCRIPTION OF THE SEVERAL VIEWS OF DRAWINGS

To those, and such other objects that may hereinafter appear, the present invention relates to an awning topper curtain rod extender as set forth in detail in the following specification and recited in the annexed claims, taken together with the accompanying drawings, wherein like numerals refer to like part, and in which:

DETAILED DESCRIPTION OF THE INVENTION

Figure 1:
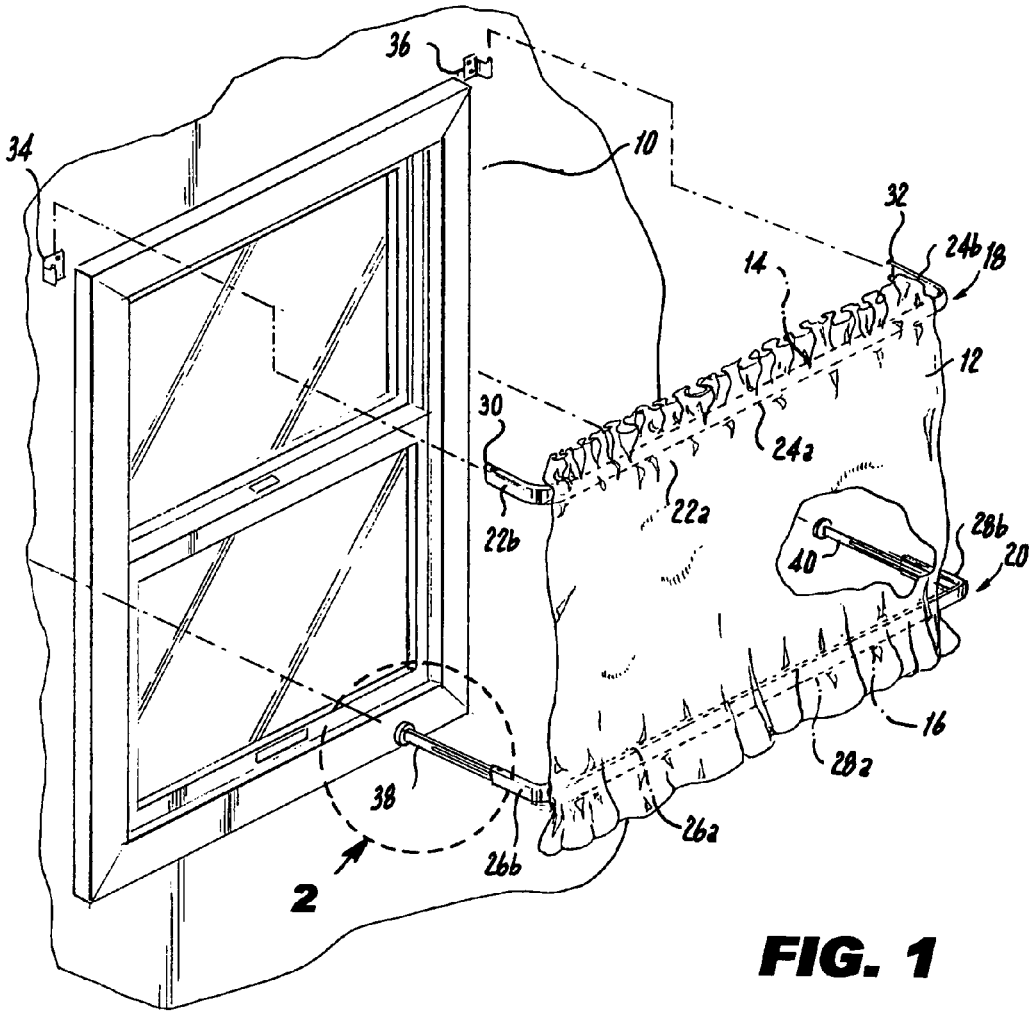
FIG. 1 is an isometric view of the awning topper curtain assembly of the present invention, illustrating how it is mounted on a window.
Figure 2:
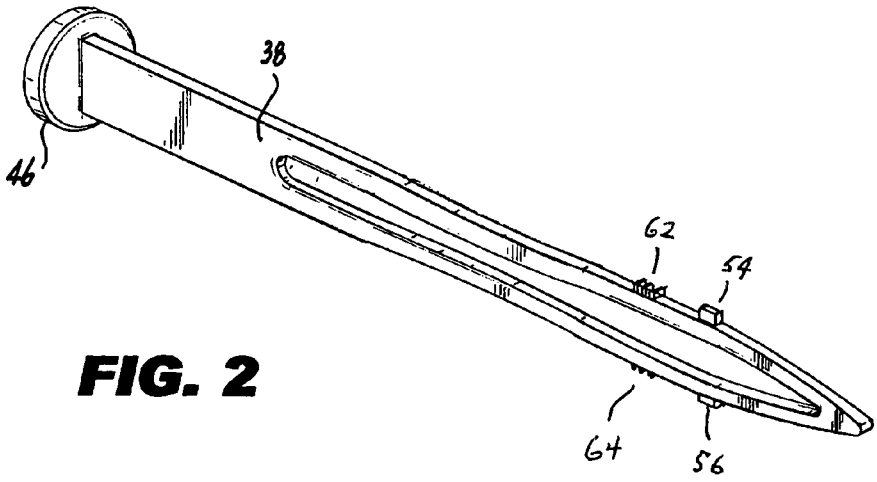
FIG. 2 is an isometric view of the support rod extender of the present invention.
Figure 5:
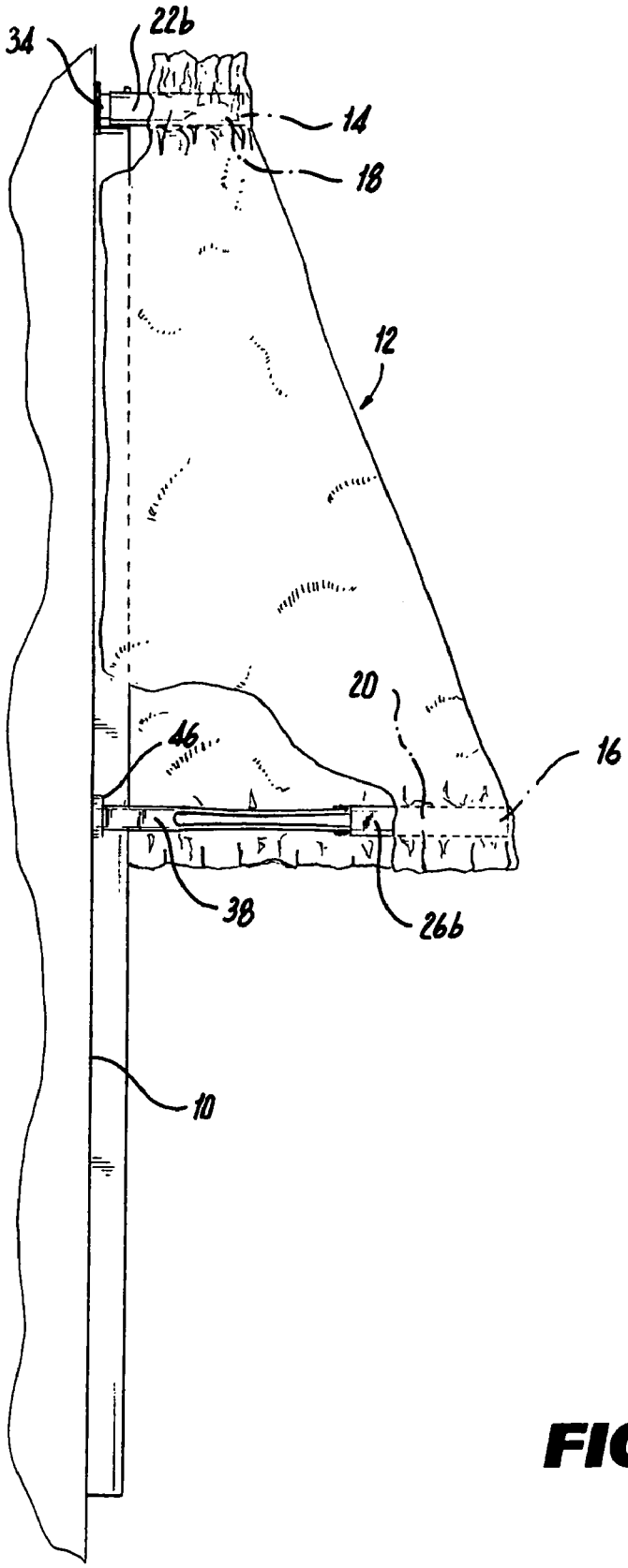
FIG. 5 is a side elevation, partially cut away view of the mounted awning topper curtain assembly.

As illustrated in FIGS. 1 and 5, the awning topper assembly of the present invention is designed for mounting on the interior side of a window. The window is surrounded by a surface 10, which can be the surface of the frame of the window to which the assembly is mounted, or as shown in the drawings, the surface of the interior wall of the room surrounding the window to which the assembly is mounted.

The assembly includes a curtain topper or valance 12 made of any suitable curtain material such as cotton fabric or a fabric formed of a blend of cotton and polyester. Valance 12 is sewn so as to form upper and lower horizontally extending curtain support rod receiving channels 14, 16 as is conventional in window treatments. The top and bottom edges of the valance may be gathered as shown for enhanced appearance.

Upper and lower telescoping curtain support rods 18, 20 are adapted to be received in channels 14, 16 respectively. Curtain support rods 18, 20 are of conventional design. Each rod is formed of two "L" shaped hollow metal rod parts. Upper support rod 18 is formed of a left part 22 and a right part 24. Lower support rod 20 is formed of a left part 26 and a right part 28.

Each part of upper rod 18 includes a long front section 22*a*, 24*a*, and a short side section 22*b*, 24*b*. Each part of lower rod 20 includes a long front section 26*a*, 28*a*, and a short side section 26*b*, 28*b*.

As is conventional in this type of curtain support rod, the cross-sectional dimension of the front section of one of the parts of each rod 18, 20 is smaller than that of the cross-sectional dimension of the front section of the other part of that rod. Thus, the front section of one part of the rod can be slideably received within the front section of the other part of the rod. This permits the parts of the rod to be connected within the curtain channel by inserting the front sections of the rod parts into the opposite ends of the curtain channel. It also permits the width of the rod to be adjusted, as needed to fit the valance.

When assembled, each support rod 18, 20 has a "U" shaped configuration, with a front formed of front sections 22*a*, 24*a* and 26*a*, 28*a* respectively and generally parallel side sections 22*b*, 24*b*, and 26*b*, 28*b*, respectively.

The ends 30, 32 of sides 22*b*, 24*b* of upper support rod 18 are attached to mounting brackets 34, 36 fixed to surface 12 on either side of the window, as is conventional. In that manner, the top of valance 10 is situated a short distance from the plane of the window, as seen in FIG. 5. However, to achieve the look of an awning, the lower portion of the valance must be spaced from the plane of the window a much greater distance from the plane of the window than the top portion.

To achieve that, and still utilize a curtain support rod of conventional design, first and second rod side extenders 38, 40 are utilized. As illustrated in FIGS. 1 and 5, the rod side extenders serve to increase the effective length of the side sections of the lower support rod 20 so as to retain the bottom portion of the valance in the desired position, spaced from the plane of the window a distance that is greater than the distance that the top portion of the valance is spaced from the plane of the window.

Figure 3:
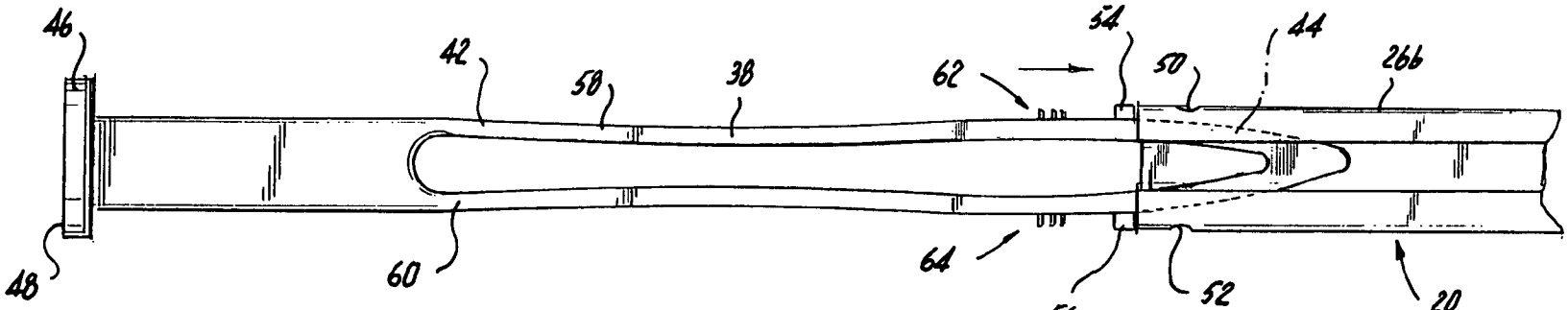
FIG. 3 is a side elevation view showing the extender as it is being inserted into a curtain support rod.
Figure 4:
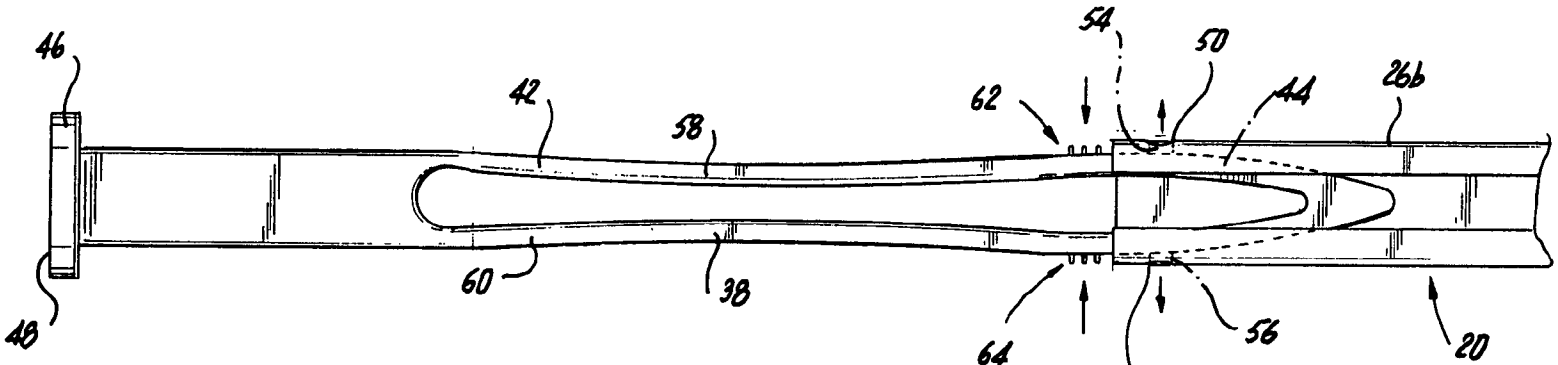
FIG. 4 is a view similar to FIG. 3 showing the extender fully inserted into the support rod.

As shown in FIGS. 3 and 4, each of extenders has an elongated body portion 42 the tip 44 of which is adapted to be received in, and engage, the hollow end of the side of the curtain support rod 20 to which it is attached. Each extender also includes an abutting part 46 connected to the rear of body portion 42. The abutting part 46 may be circular, as illustrated, or any other suitable shape. Abutting part 46 has a rear, circular abutting surface 48. That abutting surface is adapted to be situated adjacent surface 12 surrounding the window. Preferably, abutting part 46, and thus abutting surface 48, is larger in diameter than the height of the body portion of the extender.

As will now be appreciated, the weight of valance 12 causes a bending moment around an axis defined by upper support rod 18. That weight constitutes a force that is applied entirely in a direction perpendicular to the plane of the window, such that it tends to push the abutting part 46 of the extender toward the surface 12 surrounding the window. Since there is no downwardly directed component of that force, there is no need to fix the end of the extender to surface 10.

As is best seen from FIGS. 3 and 4, the tip 44 of the extender is adapted to be received within the hollow end of the side of the curtain support rod. More particularly, the top and bottom walls of the rod side have first and second aligned protrusion-receiving recesses 50, 52 respectively. Those recesses are normally provided in the curtain support rod to be engaged by a wall mounting bracket of the type shown as brackets 34, 36 for the upper curtain support rod 18. The tip 44 of the body portion 42 of the extender includes first and second aligned protrusions 54, 56 extending respectively from the top and bottom surfaces of the extender. Protrusions 54, 56 are adapted to be received in recesses 50, 52 respectively to attach the extender to the rod side.

Preferably, tip 44 is tapered to facilitate insertion of the extender into the hollow end of the rod side. The extender can easily be inserted into the rod side until the protrusions abut the edge of the extender, as seen in FIG. 3.

Preferably, body portion 42 is of the extender is formed of first and second spaced, generally parallel legs 58, 60. Legs 58, 60 are made of flexible plastic material. By squeezing the extender near the tip, the legs of the extender are moved together, reducing the effective height of the extender, such that protrusions 54, 56 can enter the inside of the rod side. The extender can then be inserted further into the end of the rod side until they align with recesses 50, 52 respectively. Releasing the force applied to the extender will permit the protrusions to lodge in the respective recesses, as shown in FIG. 4. This will keep the extender situated in the rod side and act as a means of limiting the distance into the rod side the extender is inserted, thereby assuring that the lower portion of the valance will be situated the desired distance from the plane of the window.

To assist the installer in applying the squeezing force at the appropriate point on the extender to move the protrusions toward each other, gripping sections 62, 64 are formed on the outer surfaces of legs 58, 60 respectively. Those gripping sections are each defined by a plurality of outwardly extending, spaced, flexible protrusions, as seen in the drawings.

It will now be appreciated that the present invention relates to an awning topper curtain that is mounted to the interior of a window using two conventional curtain support rod and a pair of rod side extenders. The extenders are received in the end of the curtain support rod side and have a rear surface adapted to abut the surface surrounding the window. The extenders retain the bottom of the curtain topper at a distance from the plane of the window further than the top of the curtain topper to provide the appearance of an awning.

While only a single preferred embodiment of the present invention has been disclosed for purposes of illustration, it is obvious that many variations and modifications could be made thereto. It is intended to cover all of those variations and modifications that fall within the scope of the present invention, as recited in the following claims.

I claim:

1. An awning topper assembly for mounting on the interior side of a window surrounded by a surface, said assembly comprising first and second curtain support rods, each of said rods comprising a front and a hollow side, said side of said first support rod having a length substantially equal to the length of said side of said second support rod, a valance having upper and lower channels adapted to receive said first and second rods, respectively, and rod side extender means, said extender means comprising an end adapted to abut the surface surrounding the window and a body portion comprising first and second normally spaced flexible parts adapted to be moved relative each other to permit said body portion to be at least partially received in said side of said second support rod, so as to retain said side of said second support rod at a location spaced from the surface surrounding the window, such that said front of said second rod is situated a greater distance from the surface surrounding the window than said front of said first rod.

2. The assembly of claim 1 wherein said end of said extender means further comprises an enlarged surface adapted to abut the surface surrounding the window.

3. The assembly of claim 1 wherein the weight of said valance tends to push said end of said extender means towards the surface surrounding the window.

4. The assembly of claim 1 wherein said rod side comprises a protrusion-receiving recess and wherein said body portion comprises a protrusion adapted to be received in said recess.

5. The assembly of claim 1 wherein said body portion comprises a tapered tip.

6. The assembly of claim 1 wherein said body portion further comprises gripping means for facilitating the movement of said parts relative to each other.

7. The assembly of claim 2 wherein said enlarged surface is generally circular in configuration.

8. The assembly of claim 2 wherein said enlarged surface is larger in diameter than said body portion.

* * * * *